United States Patent [19]

Steffen

[11] 4,004,352

[45] Jan. 25, 1977

[54] GRAIN DRYING APPARATUS

[76] Inventor: Vincent B. Steffen, 321 E. Hamilton, New Hampton, Iowa 50659

[22] Filed: Jan. 16, 1975

[21] Appl. No.: 541,384

[52] U.S. Cl. ..... 34/233; 98/55

[51] Int. Cl.[2] ..... F26B 19/00

[58] Field of Search ..... 34/174, 175, 168, 224, 34/225, 232–235; 98/55

[56] References Cited

UNITED STATES PATENTS

| | | | |
|---|---|---|---|
| 2,782,705 | 2/1957 | Breidert | 98/55 |
| 2,797,632 | 7/1957 | Hook | 98/55 |
| 3,041,956 | 7/1962 | Miles | 98/55 |
| 3,111,399 | 11/1963 | Trom | 34/233 |
| 3,426,445 | 2/1969 | Steffen | 98/55 |

FOREIGN PATENTS OR APPLICATIONS

| | | | |
|---|---|---|---|
| 240,600 | 9/1962 | Australia | 126/270 |

*Primary Examiner*—Kenneth W. Sprague
*Assistant Examiner*—James C. Yeung
*Attorney, Agent, or Firm*—Henderson, Strom & Sturm

[57] ABSTRACT

A grain bin having a roof, a perforated floor, a grain storage chamber above the floor, a plenum chamber below the floor and a fan for forcing air into the plenum chamber, through the floor and ultimately through the grain storage chamber. A ventilation structure is attached to the roof of the bin in direct communication with the top of the grain storage chamber and has a plurality of turbine shaped blades fixed together and mounted for free-spinning rotation with respect to the roof.

5 Claims, 4 Drawing Figures

GRAIN DRYING APPARATUS

BACKGROUND OF THE INVENTION

The present invention relates generally to grain drying and storing and more particularly to an apparatus for achieving proper ventilation of grain in a grain bin during the drying and storing process.

When grain is dried in a grain bin by circulating air through the grain, a crust tends to form in the grain, especially on the top layer thereof, because of an accumulation of moisture. It has been found that if the exhaust pressure of the air in a drying grain bin is maintained under a higher pressure, that this condition will tend to retain more moisture in the air than if it were under a lower pressure, and consequently that this moisture can be kept in the air until it is received into the atmosphere, at which time the moisture is then free to condense without depositing this moisture on the top layers of the grain. It has therefore been a problem of how to regulate the pressure in order to achieve this desired result.

Grain bins normally have an access opening at the top thereof. This opening is used for example to introduce the grain into the bin initially. This access opening normally has a door associated therewith. This door would, of course, be open when grain is being introduced into the bin and it would also be open during the drying process. During both the drying and the storing processes, this door would need to be manually or otherwise closed during rainy or snowy weather conditions in order to prevent moisture from entering the bin. Consequently, it can be clearly understood that there is a monitering problem with the use of a door. Someone must always be around to insure that the door is open at the proper time and closed when there is precipitation in the weather conditions.

Furthermore, the size of such an access opening is normally fixed such that the control of air therethrough can not readily be varied because the orifice size of such access opening is normally either wholly open or completely closed.

Accordingly, there is a need for a ventilating device which serves the function of a variable restriction so as to properly modulate the passage of air therethrough in order to prevent premature condensation of the moisture in the air passing through the bin. This will keep such moisture out of the grain and, as is especially important, from depositing on the upper layers of the grain.

There is also a need to have a variable restriction ventilating device which can function properly during both the drying and the storing cycles of the grain, so that doors do not need to be constantly regulated and so that separate devices are not needed for drying and storing.

SUMMARY OF THE INVENTION

The present invention relates to a grain drying and storing apparatus including a bin having a perforated floor therein. The perforated floor divides the bin into a lower plenum chamber and grain storage chamber. An exhaust chamber is formed between the top of the grain and the roof of the bin. An air circulating mechanism is associated with the plenum chamber for introducing air therein. A ventilating mechanism is disposed in the exhaust chamber for allowing modulation of the air which exhausts the bin for the purpose of preventing moisture from collecting in the grain storage chamber.

An object of the present invention is to prevent the crust which tends to form on grain during the grain drying process.

Another object of the present invention is to modulate the air pressure within the exhaust chamber to thereby maintain a higher than atmospheric pressure within the exhaust chamber.

A further object of the invention is to ventilate grain, once dried, without having to manually open and close a door during successive rainy and non-rainy periods.

Still another object of this invention is to remove static heat under a grain bin roof.

A still further object of the invention is to aerate and dry stored grain with a minimum use of energy.

Other objects, advantages, and novel features of the present invention will become apparent from the following detailed description of the invention when considered in conjunction with the accompanying drawings.

DESCRIPTION OF THE PREFERRED EMBODIMENTS

Figure 1:
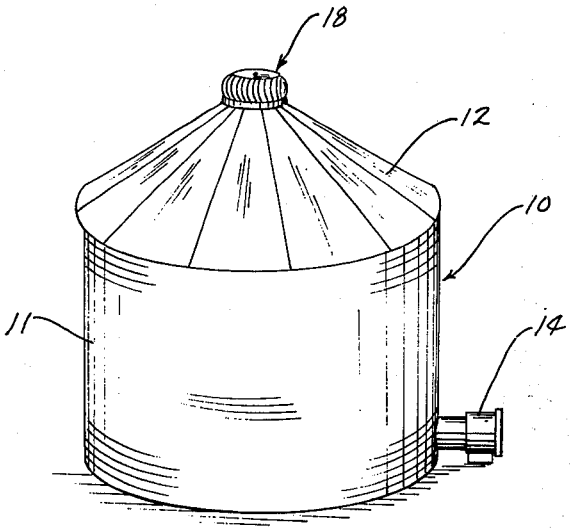
FIG. 1 is a perspective view of a grain bin utilizing the modulating and ventilating combination of the present invention.
Figure 2:
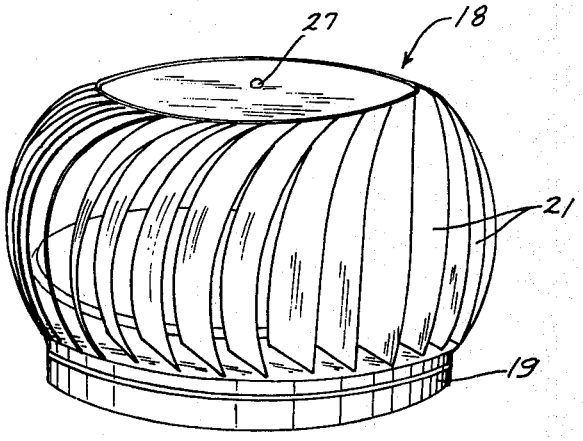
FIG. 2 is a perspective view of the turbine-type ventilating device used in the present invention.
Figure 3:
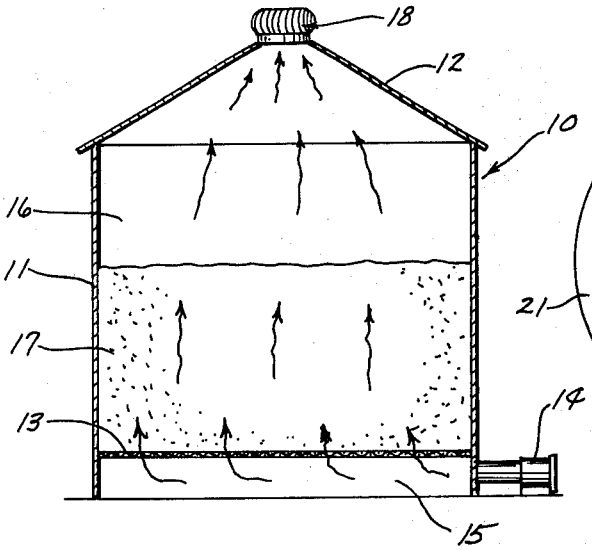
FIG. 3 is a cross-sectional view of the present invention.

Referring now to the drawings wherein like reference numerals designated identical or corresponding parts throughout the several views, FIGS. 1 and 3 show a grain bin 10 having side walls 11, a roof 12 and a perforated floor 13. At least one air circulating mechanism 14 is attached to the grain bin at a point below the perforated floor 13. This air circulating mechanism 14 also preferably has a heating mechanism associated therewith, but such heating device is not shown.

The air circulating mechanism is, for example, an electric fan which is in communication with a bottom plenum chamber 15. A top plenum chamber or exhaust chamber 16 is formed above the level of the grain 17 within the bin 10, but below the roof 12. An opening at the top of the grain bin 10, in the roof 12, has a turbine 18 attached thereto.

Figure 4:
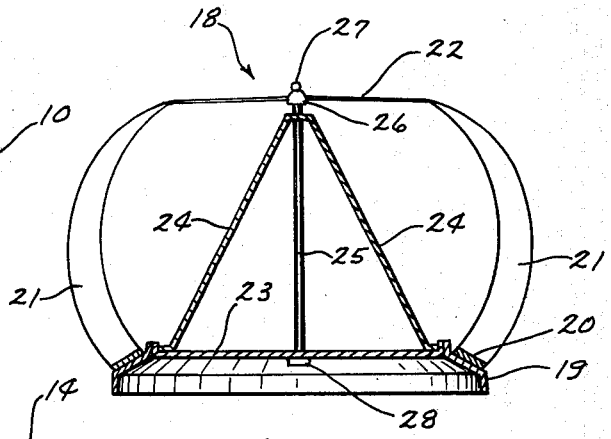
FIG. 4 is a cross-sectional view of the turbine-type ventilating device used in the present invention.

This turbine 18 (FIG. 4) has a circular base 19, upon which is slideably disposed a circular member 20. Attached to the circular member 20 is a plurality of arcuately shaped blades 21. These blades are rigidly affixed to the circular member 20 at one end and to a plate like member 22 at the other end thereof.

Brace members 23 and 24 (FIG. 4) serve to pivotally attach the turbine blades to the base 19 by a rod 25 which is rotatably received through the members 22, 23 and 24. A washer-like member 26 is disposed between the plate 22 and the members 24 for the purpose of enhancing free rotation of the turbine blades 21. Nut members 27 and 28 serve to secure the rod 25 in its proper place. It is to be understood, however, that this particular design shown in FIG. 4 for mounting the turbine 21 is not critical, and that other equivalent structures can be used to rotatably mount the turbine blades 21 to the grain bin 10.

In operation, grain would be introduced into the grain bin 10 through the access opening at the top of the grain bin 10. Once the desired amount of grain 17 has been introduced, the turbine ventilator 18 would then be secured to the grain bin such as by sliding it into the top access opening. Since field harvested grains normally have a higher moisture content than is desirable for storage, the air circulating means 14 along with any desired heating mechanism (not shown) is actuated in order to cause the circulation of air from the atmosphere to the lower plenum chamber 15, through the perforated floor 13, through the grain 17 to the exhaust chamber 16 and out through the turbine device 18.

During such a drying operation, the turbine 18 serves as a variable restriction to modulate or meter the flow of air through the exhaust chambers 16. In performing this function, a high pressure is maintained within the exhaust chamber 16 to thereby insure that to a large degree that the moisture within the air and chamber 16 stays in the air and does not condense on the sides or onto the top of the grain 17. Once the air flows through the turbine 18 and is allowed to mix with the atmospheric air at atmospheric air pressures outside of the bin 10, much of the moisture is then released by condensation, but it is not deposited upon the grain 17.

The higher pressure which is maintained above the grain 17 during the drying process causes a higher air flow out of the turbine 18 and consequently causes the turbine 18 to spin faster. Faster spinning of the turbine 18 increases the resistence to the air flow from the bin and exhaust chamber 16 as compared to what would happen with a fixed orifice device. Consequently, as the turbine 18 spins faster it tends to reduce the rate of air flow from the bin to thereby counteract to some extent the increased air flow caused by such higher pressure within the chamber 16, to thereby build up and modulate the air flow in order to maintain the desired higher pressure in the upper plenum or exhaust chamber 16.

Once the grain has been dryed to the desired extent, the air circulating mechanism 14, including any heater associated therewith, is disengaged. Consequently air flow through the bin is not present to cause spinning of the turbine 18. It is still necessary, however, to keep the grain properly ventilated for aeration and to prevent static heat from building up in the grain. Therefore the turbine air modulating device 18 is ideally suited to perform such function also. Wind from the atmosphere will turn the turbine 18 and force fresh air into the bin. Additionally the turbine 18 prevents the entry of significant amounts of rain or snow from entering the bin 10 through the top access opening without a need for manual closing or opening.

Obviously many modifications and variations of the present invention are possible in light of the above teachings. It is therefore to be understood that, within the scope of the appended claims, the invention may be practiced otherwise than as specifically descirbed.

I claim:

1. Grain bin apparatus comprising:

a bin;

a perforated floor in said bin;

a chamber on each side of said floor;

air circulating means connected to said bin for forcing air under pressure to enter one of said chambers and exhaust from an opening in the other of said chambers; and means rotatably attached to said bin and encompassing said opening for modulating the flow of air exhausting out of said other chamber, said modulating means having a substantially horizontally disposed fluid impervious central plate member for substantially preventing precipitation from entering the bin and a plurality of spaced turbine-shaped blades connected to said central portion and extending downwardly therefrom.

2. Apparatus as defined in claim 1 wherein said blade means is also rotatable in response to atmospheric wind currents.

3. Apparatus as defined in claim 1 wherein said modulating means comprises a framework having a circular portion thereon; and a plurality of arcuately shaped blades connected to a circular band, said circular band slideably contacting said circular portion to allow free rotation of said circular band and arcuately shaped blades.

4. Apparatus as defined in claim 1 wherein said air circulating means comprises a fan.

5. Apparatus as defined in claim 1 wherein said modulating means further comprises a circular band having said blades connected at the lower ends thereof to said circular band.

* * * * *